US005205430A

United States Patent [19]

Valyi

[11] Patent Number: 5,205,430

[45] Date of Patent: Apr. 27, 1993

[54] PLASTIC CONTAINER CLOSURE

[76] Inventor: Emery I. Valyi, 19 Moseman Ave., Katonah, N.Y. 10536

[21] Appl. No.: 907,814

[22] Filed: Jul. 2, 1992

[51] Int. Cl.[5] ..... B65D 17/44; B65D 51/22

[52] U.S. Cl. ..... 220/278; 220/253; 220/254; 220/258; 220/267; 222/83

[58] Field of Search ..... 220/213, 253, 254, 255, 220/256, 258, 267, 277, 278; 222/83, 541

[56] References Cited

U.S. PATENT DOCUMENTS

| | | | |
|---|---|---|---|
| 2,615,610 | 10/1952 | White | 220/254 |
| 2,772,808 | 12/1956 | Fried | 220/277 |
| 3,220,598 | 11/1965 | Fried et al. | 220/284 X |
| 3,250,424 | 5/1966 | Martin | 220/277 |
| 3,486,665 | 12/1969 | LaCroce | 220/253 X |
| 3,726,432 | 4/1973 | Gentile | 220/253 |
| 3,889,842 | 6/1975 | Bennett | 220/253 |
| 4,544,079 | 10/1985 | Elrick | 220/277 |
| 4,717,039 | 1/1988 | Ayyoubi | 220/253 |
| 4,747,511 | 5/1988 | Dutt et al. | 220/307 |
| 4,840,289 | 6/1989 | Fait et al. | 220/359 |

*Primary Examiner*—Allan N. Shoap
*Assistant Examiner*—Vanessa Caretto
*Attorney, Agent, or Firm*—Bachman & LaPointe

[57] ABSTRACT

Plastic closure having a lid with a rim suitable for engagement with a plastic container to close said container, with the lid having an access opening therein, and a barrier liner adhered to the underside of the lid and having a raised portion thereof extending through the access opening. A cap is provided adjacent the top of the lid operative to cut the raised portion and form a closable opening.

17 Claims, 2 Drawing Sheets

PLASTIC CONTAINER CLOSURE

BACKGROUND OF THE INVENTION

The present invention deals with plastic closures for plastic containers having wide top openings, such as jars and cans, so-called wide mouth containers.

It is difficult to provide a wide-mouth plastic container with a plastic closure capable of being easily opened and closed without the use of a tool, particularly where a barrier material is needed as part of the closure in order to maintain the integrity of the contents of the container. According to current practice plastic carbonated beverage cans, for example, are provided with a metal end, the same as the aluminum cans they are intended to replace. The metal end is equipped with an easy open fitment featuring a score and a lever, and involving pressing against the pre-scored piece of the end so that the score may be torn and the can thereby opened. Plastic ends are not used due to their limited resistance to gas permeation and the difficulty of opening same without a special opening tool.

It is, thereby, a principal objective of the present invention to provide a plastic container closure for plastic containers wherein the closure has resistance to gas permeation as well as the capability of being easily opened and closed.

It is a still further objective of the present invention to provide a plastic container closure as aforesaid which is easy to prepare, inexpensive and easy to use in practice.

Further objects and advantages of the present invention will appear hereinbelow.

SUMMARY OF THE INVENTION

In accordance with the present invention the foregoing objects and advantages are readily obtained.

The present invention provides a plastic container closure for plastic containers, which comprises: a plastic lid having top and bottom surfaces and a peripheral rim suitable for engagement with a plastic container to close said container, said lid having an access opening therein; a barrier liner adjacent to and usually bonded to and covering substantially the entire bottom surface of the lid, said barrier liner having a raised portion thereof extending through the access opening of the lid; and movable means as a cap adjacent the top surface of said lid independently movable relative thereto and operative to cut said raised portion and thereby to provide an opening in the barrier liner corresponding to the access opening in a first position of said cap and to close said opening in a second position of said cap.

In the preferred embodiment, the lid is attached to a can body and the lid and liner are of generally annular shape.

For easy use, the movable means is preferably a member which is rotatably held in a circular bearing groove or bearing surface in the lid, not precluding the use of a linearly slidable member. The raised portion of the liner extends through the access opening and above the top surface of the lid, exposed to the same pressure as the inside of the container, and the cap member includes means, such as a puncturing and/or cutting edge operative to shear the said raised portion.

The cap preferably includes grip means to facilitate moving the cap.

The cap preferably covers the lid and has a window therein so that in a further position of movement of the cap, the window corresponds to the cut portion of the liner and naturally also the access opening in the lid to provide a through opening to the interior of the container. The raised portion of the liner presses against the cap in the closed position of the container due to internal pressure, i.e., before cutting the raised portion.

Further objects, advantages and features of the present invention will appear hereinbelow.

BRIEF DESCRIPTION OF THE DRAWINGS

The present invention will be more readily understandable from a consideration of the following illustrative and partly schematic drawings wherein.

DETAILED DESCRIPTION OF PREFERRED EMBODIMENT

Figure 1:
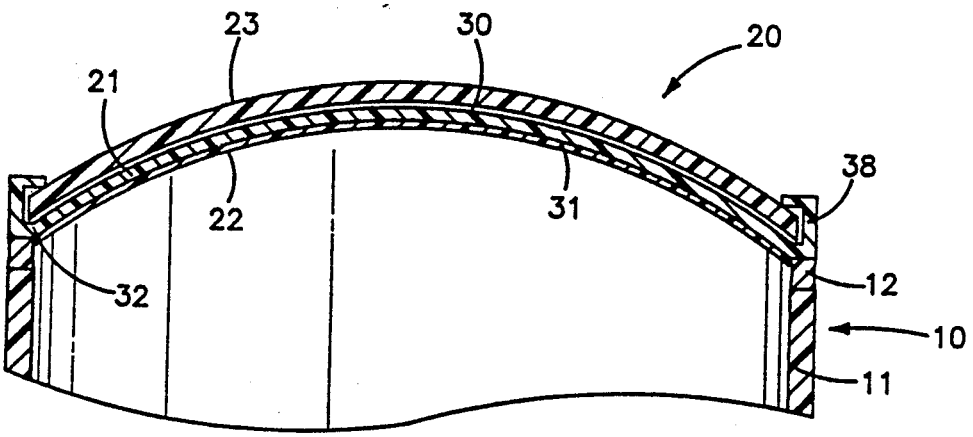
FIG. 1 is a sectional side view of the container lid of the present invention affixed to a container body.

FIG. 1 shows a sectional side view of a container 10 having container side walls 11 extending upwardly from a container bottom (not shown) and terminating in a container closure 20 affixed to the side walls as by welding at weld 12. The container 10-closure 20 combination of the present invention is particularly useful as an all plastic container for carbonated beverages, but naturally the present invention is not limited thereto.

Closure 20 comprises a layered assembly, preferably annular, consisting of a plastic lid 21, a liner 22 and an independently movable cap 23. The lid 21 has a top surface 30 and a bottom surface 31 and a peripheral rim 32 for engagement with plastic container 10 as by weld 12 or by seaming or by any other desired means. Lid 21 is also provided with access opening or window 33 clearly shown in FIGS. 2 and 3. In the drawings, the thickness of the liner has been exaggerated for clarity.

Liner 22 is beneath the lid and may be bonded to and cover the entire bottom surface 31 of lid 21. Liner 21 is provided with raised portion 35 shown in FIG. 3 which extends through access opening 33. Cap 23 may cover the entire top surface 30 of lid 21 and is operative to cut the raised portion 35 of liner 22 to provide an opening therein corresponding to access opening 33.

The cap 23 is preferably held in circular bearing groove 38 of lid 21 which extends from rim 32. Raised portion 35 generally presses against cap 23 due to the internal pressure in the container and is thereby kept from bulging outward, the cap being designed to provide space between it and top surface 30 of lid 21 for raised portion 35 to extend into.

Figure 2:
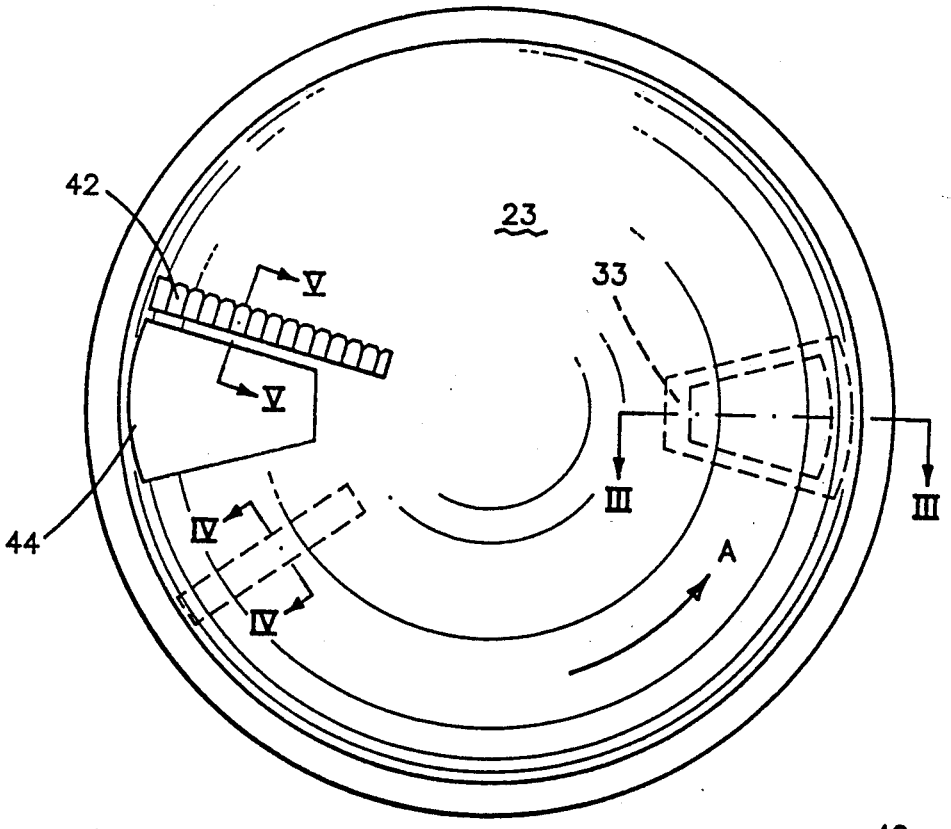
FIG. 2 is a top view of the container lid of FIG. 1.
Figure 4:
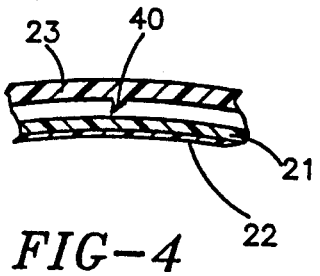
FIG. 4 is a sectional view along line IV—IV of FIG. 2.
Figure 5:
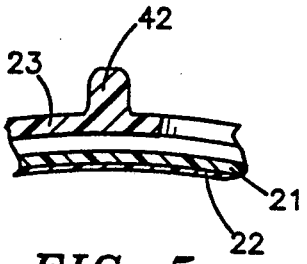
FIG. 5 is an exaggerated sectional view along line V—V of FIG. 2.
Figure 3:
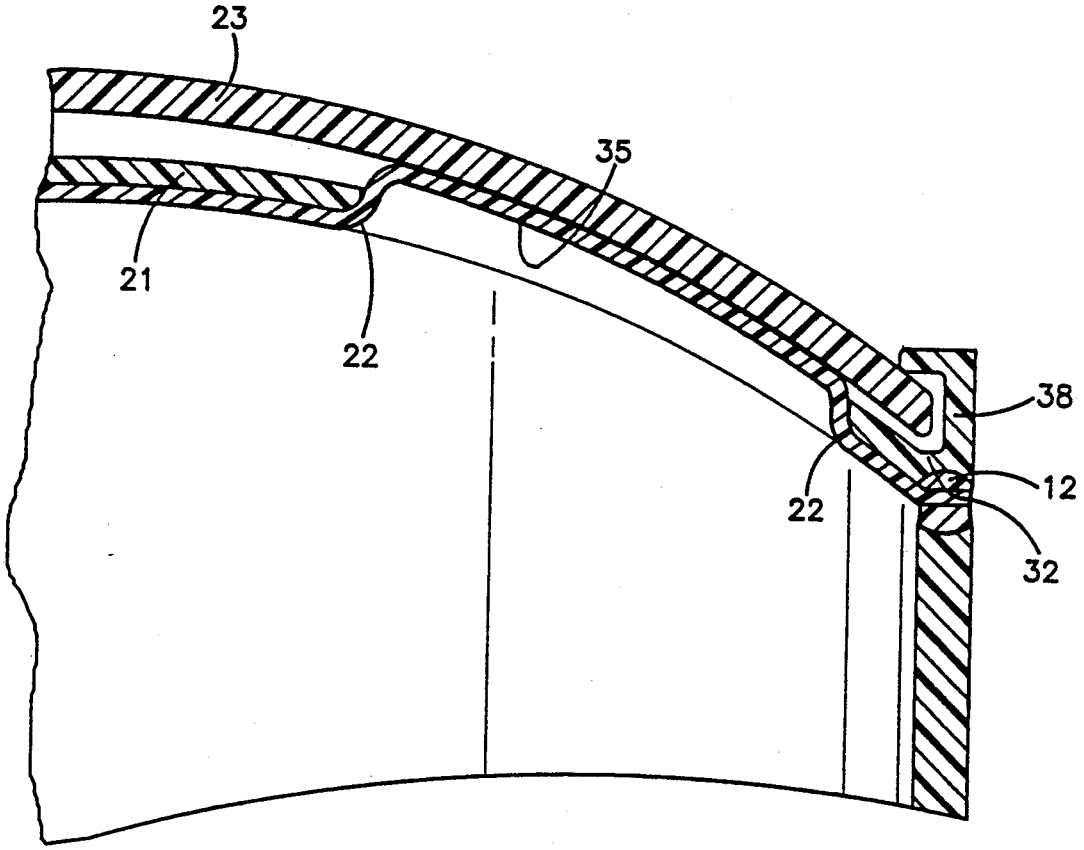
FIG. 3 is a sectional view along line III—III of FIG. 2.

As shown in FIG. 4, a sharp-edged cutting protrusion 40 depends from cap 23 to effect cutting of raised portion 35 upon movement of cap 23 in the direction of arrow A in FIG. 2. Protrusion 40 may have a sharp point or edge as shown to puncture raised portion 35 to release the pressure therein and then cut a larger opening. Alternatively, a separate means may be provided to first depressurize followed by cutting. Cap 23 also carries a wing-like raised portion 42 (see FIGS. 2 and 5) on its outer surface to grasp between fingers. Cap 23 has a window or cut-out 44 therein so that upon movement of the cap to cut raised portion 35, window 44 corresponds to the cut portion of the liner as well as access opening 33 to provide a through opening to the interior of the container.

The lid is preferably formed of polyethylene terephthalate, but naturally any suitable plastic can readily be used. The liner is preferably highly crystalline oriented polyethylene terephthalate, but naturally any suitable barrier may be used, as for example EVOH. The cap is preferably also polyethylene terephthalate so as to simplify recycling, but naturally other material may readily be used as the cap or movable member.

It can be seen that the present invention readily prevents diffusion of gas from the contents of the container through closure 20. Before the can is opened, cap 23 is positioned as shown in FIG. 2 so that window 44 is spaced from access opening 33. As indicated hereinabove, in this position, raised portion 35 of liner 22 presses against lid 21 and cap 23 due to the internal pressure, which also stiffens its exposed sides to resist deformation, except to a sharp indenting tool similar to pricking an inflated balloon. To open the container, the cap is turned in the direction of arrow A facilitated by means of finger grip 42 which is preferably positioned alongside window 44. As the cap is turned, protrusion 40 preferably first punctures, then shears raised portion 35 of barrier 22. Upon continuing to turn the cap, window 44 coincides with access opening 33 which is now a through opening due to the shearing of the raised portion and thereby provides a through opening to container 10. To reclose that opening, the cap is turned further or reversed until window 44 does not coincide with access opening 33. Naturally, the container is not sealed as before, but only closed since the barrier layer has been severed; however, the foregoing does provide a simple means for re-closing a container.

On the inside of the lid, i.e., on the container side, a barrier film liner is juxtaposed and preferably attached over the entire surface of the first layer. This insert liner is made of a plastic having better permeation resistance than the lid. It need not be the same material as the lid, but preferably is compatible with it for purposes of recycling. The insert liner is typically thinner than the lid; the preferred method for producing it is thermoforming. It may be inserted into an injection mold and the lid molded behind it. Alternatively, the film from which it is made may be fed over the molded lid and warm- or cold-pressed into it, depending on the amount of deformation that is required to conform it to the inside of the lid and also to form raised portion 35. Also, if desired, adhesion between liner and lid may be enhanced by an adhesive layer laminated onto the film stock, or by means of an adhesive applied, as from a spray, before contacting the two parts to be joined. Often it will be enough to join them merely by mechanical pressure.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A plastic container closure for plastic containers which comprises: a plastic lid having top and bottom surfaces and a peripheral rim suitable for engagement with a plastic container to close said container, said lid having an access opening therein; a barrier liner adjacent the bottom surface of the lid, said barrier liner having a raised portion extending through the access opening of the lid; and movable means adjacent the top surface of said lid operative to provide an opening in the liner corresponding to the access opening in a first position of said movable means and to close said opening in a second position of said movable means.

2. A closure according to claim 1 wherein said liner is bonded to and covers substantially the entire bottom surface of said lid.

3. A closure according to claim 2 wherein said movable means is a cap.

4. A closure according to claim 3 wherein said cap is independently movable relative to the lid.

5. A closure according to claim 4 wherein said lid is attached to a can body.

6. A closure according to claim 3 wherein the cap is movably held in a bearing surface of the lid.

7. A closure according to claim 3 wherein the raised portion extends through the access opening and above the top surface of the lid.

8. A closure according to claim 7 wherein the cap includes grip means to facilitate moving the cap.

9. A closure according to claim 7 wherein the cap includes means operative to sever the raised portion of the liner.

10. A closure according to claim 7 wherein the cap covers the liner and has a window therein so that in one, position of the cap the window corresponds to the opening in the liner and said access opening to provide a through opening to said container.

11. A closure according to claim 7 wherein the raised portion presses against the cap member in the container closed position.

12. A closure according to claim 1 wherein the lid and liner have a generally annular shape.

13. A closure according to claim 1 wherein the lid is polyethylene terephthalate.

14. A closure according to claim 10 wherein the liner is oriented crystalline polyethylene terephthalate.

15. A closure according to claim 14 wherein said closure is entirely of polyethylene terephthalate.

16. A closure according to claim 3 wherein said cap is at least in part spaced from the lid.

17. A closure according to claim 9 wherein the cap includes means to release pressure in the container followed by shearing the raised portion.

* * * * *